US008748005B2

(12) United States Patent
Chen et al.

(10) Patent No.: US 8,748,005 B2
(45) Date of Patent: Jun. 10, 2014

(54) PCB PROTECTING COVER, LCD DEVICE, AND METHOD FOR MANUFACTURING PCB PROTECTING COVER

(75) Inventors: Shihhsiang Chen, Shenzhen (CN); Chengwen Que, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/516,750

(22) PCT Filed: May 22, 2012

(86) PCT No.: PCT/CN2012/075880

§ 371 (c)(1),
(2), (4) Date: Jun. 18, 2012

(87) PCT Pub. No.: WO2013/143220

PCT Pub. Date: Oct. 3, 2013

(65) Prior Publication Data

US 2013/0260163 A1 Oct. 3, 2013

(30) Foreign Application Priority Data

Mar. 29, 2012 (CN) ..... 2012 1 0087538

(51) Int. Cl.
*B32B 23/04* (2006.01)

(52) U.S. Cl.
USPC ..... 428/532; 428/537.5; 206/721; 349/56

(58) Field of Classification Search
USPC ..... 428/532; 206/721; 349/60
See application file for complete search history.

(56) References Cited

U.S. PATENT DOCUMENTS

| | | | | |
|---|---|---|---|---|
| 5,205,406 | A * | 4/1993 | Bradford | 206/721 |
| 5,989,696 | A * | 11/1999 | McCarthy et al. | 428/221 |
| 7,365,812 | B2 * | 4/2008 | Lee | 349/60 |

FOREIGN PATENT DOCUMENTS

| | | | |
|---|---|---|---|
| CN | 1489108 | A | 4/2004 |
| CN | 101276080 | A | 10/2008 |
| CN | 201583766 | U | 9/2010 |
| JP | 2009238716 | A | 10/2009 |

OTHER PUBLICATIONS

Zhong Yu, the International Searching Authority written comments, Jan. 2013, CN.

* cited by examiner

*Primary Examiner* — Leszek Kiliman
(74) *Attorney, Agent, or Firm* — IPro, Inc.; Na Xu

(57) ABSTRACT

The invention provides a PCB protective cover, an LCD device, and a method for manufacturing a PCB protective cover. The PCB protecting cover is made of an antistatic paper material. The invention provides a novel paper PCB protecting cover. The PCB protecting cover has the advantages of good mechanical strength, simple processing, and low cost, and has antistatic ability because of being added with an antistatic material, thereby greatly reducing the cost of the PCB protecting cover when satisfying the function requirement of the PCB protecting cover, and improving the overall competitiveness of the LCD device.

7 Claims, 3 Drawing Sheets

PCB PROTECTING COVER, LCD DEVICE, AND METHOD FOR MANUFACTURING PCB PROTECTING COVER

TECHNICAL FIELD

The invention relates to the field of liquid crystal displays (LCDs), and more particularly to a printed circuit board (PCB) protecting cover, an LCD device, and a method for manufacturing a PCB protecting cover.

BACKGROUND

An LCD has been applied to various information display devices in recent years. The LCD mainly includes a front frame, an LCD panel (Open Cell), a backlight module, and a PCB protecting cover. The backlight module is mainly used for providing a light source for the LCD device; the PCB protecting cover is mainly used for protecting an electronic component on a PCB and preventing the electronic component from being damaged by the outside force or static electricity.

A conventional LCD device usually employs a PCB protecting cover made of metal or plastic. For example, Pat. Pub. No. CN101276080A, published on Oct. 1, 2008, discloses an LCD module, a backlight module, and a component protecting cover. U.S. Pat. No. 7,365,812B2, published on Apr. 29, 2008, discloses a flat panel display device and a grounded PCB. The PCB protecting cover made of metal has good mechanical strength and high antistatic ability, but the cost of the material and mould is high; the PCB protecting cover made of plastic has good mechanical strength, and the cost is lower than that of the metal protecting cover, but the PCB protecting cover made of plastic has no antistatic ability. Thus, when the plastic protecting cover is used, the antistatic ability of the PCB must be additionally designed.

SUMMARY

In view of the above-described technical problems, the aim of the invention is to provide a PCB protecting cover, an LCD device, and a method for manufacturing a PCB protecting cover that is low-cost and can prevent static electricity.

The aim of the invention is achieved by the following technical schemes.

A PCB protecting cover is made of an antistatic paper material.

Preferably, the antistatic paper material comprises a paper layer and an antistatic layer. The antistatic layer is arranged on a surface of the paper layer. The structure is layered, which need not change existing material character, thereby having simple process.

Preferably, both sides of the paper layer are provided with the antistatic layer. Because both sides of the paper layer are provided with the antistatic layer, a conducting area is increased, thereby enhancing antistatic effect.

Preferably, only one side of the two sides of the paper layer is provided with the antistatic layer, which reduces the materials and processing time of the antistatic layer, thereby saving the material and production cost.

Preferably, the paper layer has two layers, and the antistatic layer is arranged between the two paper layers. Mechanical strength of the paper layer is more than that of the antistatic layer. Therefore, protection strength of the PCB protecting cover can be improved by employing the antistatic layer of a two-layer structure.

Preferably, the surface of the paper layer is coated with an antistatic agent, to form the antistatic layer. This is a specific antistatic material.

Preferably, the antistatic paper material is formed by mixing the antistatic material and a paper pulp. In the technical scheme, a step of additionally adding the antistatic material after forming a paper PCB protecting cover is not required, the production process is simplified. And the consistency is good because the antistatic material is integratedly mixed with the paper pulp, thereby effectively preventing the antistatic material from accidentally shedding to cause poor antistatic effect.

An LCD device comprises the PCB protecting cover mentioned above.

A method for manufacturing a PCB protecting cover comprises the steps: mixing an antistatic agent into a paper pulp; after that, shaping the PCB protecting cover according to a required shape, to form the PCB protecting cover.

The invention provides a novel paper PCB protecting cover. The PCB protecting cover has the advantages of good mechanical strength, simple processing, and low cost, and has the antistatic ability because of being added with the antistatic material, thereby greatly saving the cost of the PCB protecting cover when satisfying the function requirement of the PCB protecting cover, and improving the overall competitiveness of the LCD device.

Legends: 100. PCB protecting cover; 110. antistatic layer; 120. paper layer; 130. antistatic agent; 200. circuit board; 210. electronic component; 300. backplane.

DETAILED DESCRIPTION

The invention will further be described in detail in accordance with the figures and the preferable examples.

An LCD device comprises an LCD panel and a backlight module; both the LCD panel and the backlight module are provided with a plurality of PCBs 200. Considering an aspect of preventing mechanical impact and static electricity, a PCB protecting cover 100 is required to be arranged above the PCB 200. In the invention, the PCB protecting cover is made of an antistatic paper material. The invention will further be described in detail in accordance with an example that the PCB protecting cover 100 is applied to the backlight module.

Example 1

Figure 1:
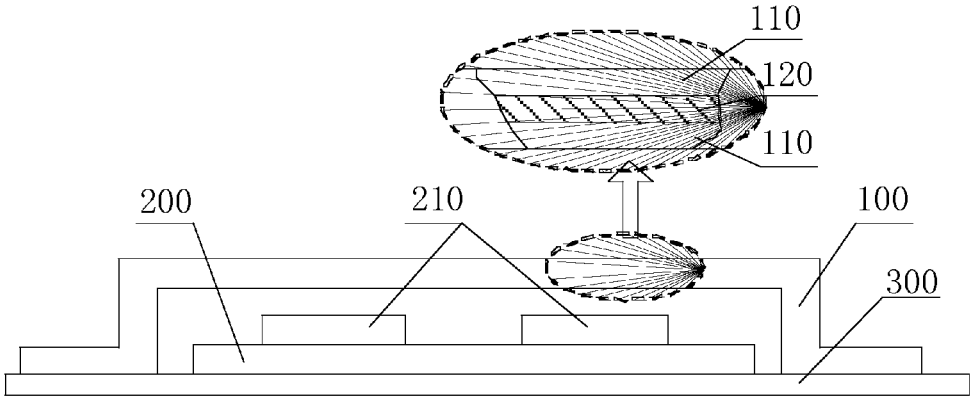
FIG. 1 is a schematic diagram of a first example of the invention.

As shown in FIG. 1, a backplane 300 of a backlight module is provided with a PCB 200, a surface of the PCB 200 is provided with a plurality of electronic components 210, and a PCB protecting cover 100 is arranged to cover the PCB 200 and fixed on the backplane 300. An antistatic paper material of the PCB protecting cover 100 comprises a paper layer 120 and an antistatic layer 110; the number of the paper layer 120 is one, and both sides of the paper layer 120 are provided with the antistatic layers 110.

A shape of the PCB protecting cover 100 is formed by folding a paper material according to a required shape, and both sides of the paper layer 120 are coated with an antistatic agent, to form the antistatic layer 110. Mechanical strength of the PCB protecting cover 100 is supplied by the paper layer 120, and static electricity is eliminated in time by the coating antistatic agent, which avoids accumulating of the static electricity. Optionally, it is feasible that an antistatic material is directly attached to a surface of the paper layer 120 to form the antistatic layer 110.

Figure 5:
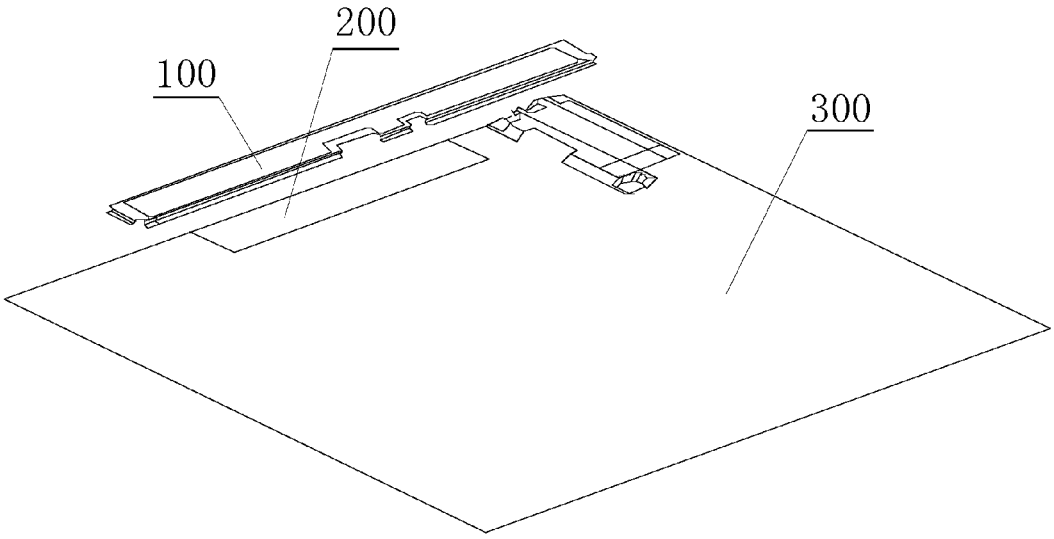
FIG. 5 is a schematic diagram of a PCB protecting cover application of the invention.

As shown in FIG. 5, the paper PCB protecting cover 100 is fixed on the backplane 300 of the backlight module by clamping, sticking or screwing, to protect the electronic component on the PCB.

Example 2

Figure 2:
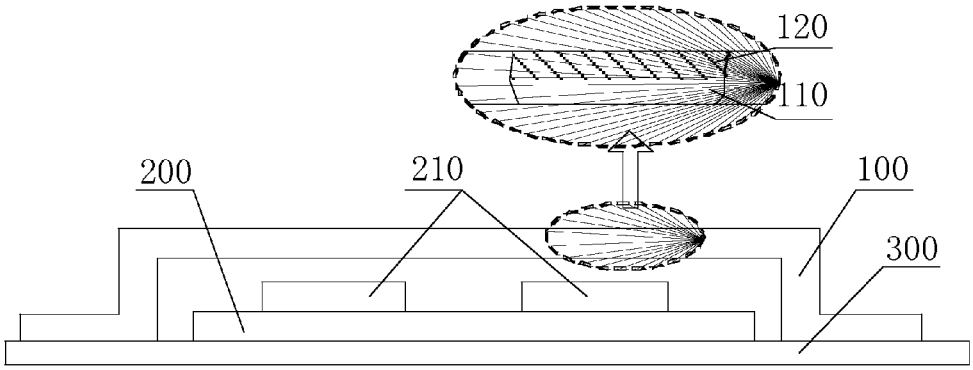
FIG. 2 is a schematic diagram of a second example of the invention.

As shown in FIG. 2, a backplane 300 of a backlight module is provided with a PCB 200, a surface of the PCB 200 is provided with a plurality of electronic components 210, and a PCB protecting cover 100 is arranged to cover the PCB 200 and fixed on the backplane 300. An antistatic paper material of the PCB protecting cover 100 comprises a paper layer 120 and an antistatic layer 110; the number of the paper layer 120 is one, and one side of the paper layer 120 is provided with the antistatic layer 110. The single-layer antistatic layer 110 can reduce the materials and processing time of the antistatic layer 110, thereby saving the material and production cost.

A shape of the PCB protecting cover 100 is formed by folding a paper material according to a required shape, and both sides of the paper layer 120 are coated with an antistatic agent, to form the antistatic layer 110. Mechanical strength of the PCB protecting cover 100 is supplied by the paper layer 120, and static electricity is eliminated in time by the coating antistatic agent, which avoids accumulating of the static electricity. Optionally, it is feasible that an antistatic material is directly attached to a surface of the paper layer 120 to form the antistatic layer 110.

As shown in FIG. 5, the paper PCB protecting cover 100 is fixed on the backplane 300 of the backlight module by clamping, sticking or screwing, to protect the electronic component on the PCB.

Example 3

Figure 3:
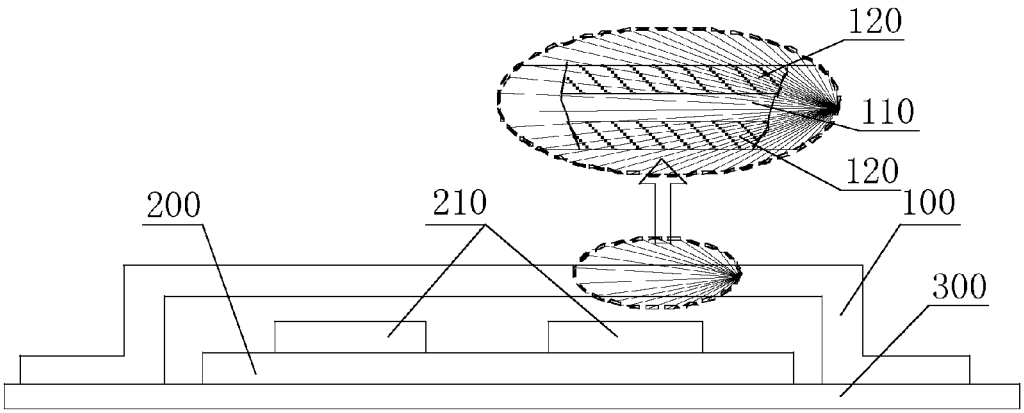
FIG. 3 is a schematic diagram of a third example of the invention.

As shown in FIG. 3, a backplane 300 of a backlight module is provided with a PCB 200, a surface of the PCB 200 is provided with a plurality of electronic components 210, and a PCB protecting cover 100 is arranged to cover the PCB 200 and fixed on the backplane 300. An antistatic paper material of the PCB protecting cover 100 comprises a paper layer 120 and an antistatic layer 110; the paper layer 120 has two layers, and the antistatic layer 110 is arranged between the two paper layers 120. Mechanical strength of the paper layer 120 is more than that of the antistatic layer 110. Therefore, protection strength of the PCB protecting cover 100 can be improved by employing the antistatic layer 110 of a two-layer structure.

A shape of the PCB protecting cover 100 is formed by folding a paper material according to a required shape, and both sides of the paper layer 120 are coated with an antistatic agent, to form the antistatic layer 110. Mechanical strength of the PCB protecting cover 100 is supplied by the paper layer 120, and static electricity is eliminated in time by the coating antistatic agent, which avoids accumulating of the static electricity. Optionally, it is feasible that an antistatic material is directly attached to a surface of the paper layer 120 to form the antistatic layer 110.

As shown in FIG. 5, the paper PCB protecting cover 100 is fixed on the backplane 300 of the backlight module by clamping, sticking or screwing, to protect the electronic component on the PCB.

Example 4

Figure 4:
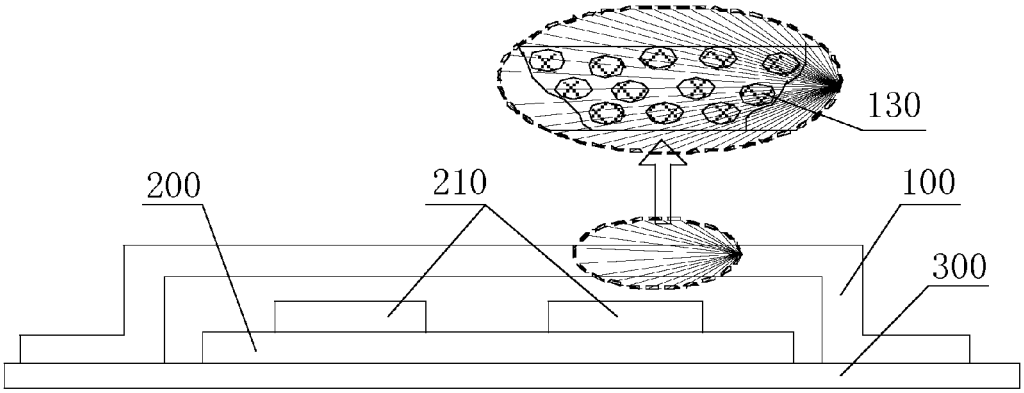
FIG. 4 is a schematic diagram of a fourth example of the invention.

As shown in FIG. 4, a backplane 300 of a backlight module is provided with a PCB 200, a surface of the PCB 200 is provided with a plurality of electronic components 210, and a PCB protecting cover 100 is arranged to cover the PCB 200 and fixed on the backplane 300. An antistatic paper material of the PCB protecting cover 100 is formed by mixing an antistatic material and a paper pulp. In the technical scheme, it is not required to additionally add the antistatic material after forming the paper PCB protecting cover 100, and the production process is simplified; moreover, the consistency is good because the antistatic material is integratedly mixed with the paper pulp, thereby preventing the antistatic material from accidentally shedding to cause poor antistatic effect.

The PCB protecting cover 100 of the example can be made by the following steps: mixing an antistatic agent 130 into the paper pulp; after that, shaping the PCB protecting cover according to a required shape, to form the PCB protecting cover 100.

As shown in FIG. 5, the paper PCB protecting cover 100 is fixed on the backplane 300 of the backlight module by clamping, sticking or screwing, to protect the electronic component on the PCB.

The invention provides a novel paper PCB protecting cover 100. The PCB protecting cover 100 has the advantages of good mechanical strength, simple processing, and low cost, and has antistatic ability because of being added with the antistatic material, thereby greatly reducing the cost of the PCB protecting cover 100 when satisfying a function requirement of the PCB protecting cover, and improving the overall competitiveness of the LCD device.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

We claim:

1. An LCD device, comprising: a backplane of a backlight module, a PCB, a PCB protecting cover; wherein the PCB arranged on the backplane of the backlight module, the PCB comprises a plurality of electronic components, the PCB protecting cover is arranged to cover the PCB and fixed on the backplane, and said PCB protecting cover is made of an antistatic paper material.

2. The LCD device of claim 1, wherein said antistatic paper material comprises a paper layer and an antistatic layer; said antistatic layer is arranged on a surface of said paper layer.

3. The LCD device of claim 2, wherein both sides of said paper layer are provided with said antistatic layer.

4. The LCD device of claim 2, wherein only one side of the two sides of said paper is provided with said antistatic layer.

5. The LCD device of claim 2, wherein said paper layer has two layers, and said antistatic layer is arranged between said two paper layers.

6. The LCD device of claim 2, wherein said surface of said paper layer is coated with an antistatic agent, to form said antistatic layer.

7. The LCD device of claim 1, wherein said antistatic paper material is formed by mixing an antistatic material and a paper pulp.

* * * * *